US009192811B1

(12) United States Patent
Miller

(10) Patent No.: US 9,192,811 B1
(45) Date of Patent: Nov. 24, 2015

(54) ELLIPTICAL EXERCISE DEVICE

(71) Applicant: Larry D. Miller, Rochester, MI (US)

(72) Inventor: Larry D. Miller, Rochester, MI (US)

(73) Assignee: Larry D. Miller Trust, Rochester, MI (US)

( * ) Notice: Subject to any disclaimer, the term of this patent is extended or adjusted under 35 U.S.C. 154(b) by 0 days.

(21) Appl. No.: 14/713,047

(22) Filed: May 15, 2015

Related U.S. Application Data

(63) Continuation-in-part of application No. 14/476,083, filed on Sep. 3, 2014.

(60) Provisional application No. 62/000,671, filed on May 20, 2014.

(51) Int. Cl.
*A63B 22/00* (2006.01)
*A63B 22/06* (2006.01)

(52) U.S. Cl.
CPC ..... *A63B 22/0664* (2013.01); *A63B 2022/067* (2013.01)

(58) Field of Classification Search
USPC ..... 482/1–148
See application file for complete search history.

(56) References Cited

U.S. PATENT DOCUMENTS

| | | | | |
|---|---|---|---|---|
| 5,577,985 | A | 11/1996 | Miller | |
| 5,611,756 | A | 3/1997 | Miller | |
| 5,911,649 | A | 6/1999 | Miller | |
| 6,045,487 | A | 4/2000 | Miller | |
| 7,556,591 | B2 * | 7/2009 | Chuang | A63B 22/001 482/51 |
| 7,651,445 | B1 | 1/2010 | Chen | |
| 7,678,025 | B2 | 3/2010 | Rodgers, Jr. | |
| 7,708,668 | B2 | 5/2010 | Rodgers, Jr. | |
| 7,794,362 | B2 | 9/2010 | Miller | |
| 7,828,698 | B2 * | 11/2010 | Rodgers, Jr. | A63B 22/001 482/51 |
| 8,092,351 | B1 | 1/2012 | Rodgers, Jr. | |
| 8,740,754 | B2 | 6/2014 | Miller | |
| 8,979,714 | B2 | 3/2015 | Miller | |
| 9,067,094 | B2 * | 6/2015 | Chang | A63B 22/001 |
| 2001/0016541 | A1 | 8/2001 | Maresh et al. | |
| 2006/0172865 | A1 | 8/2006 | Dey et al. | |

FOREIGN PATENT DOCUMENTS

AU 2007202574 A1 1/2009

OTHER PUBLICATIONS

International Search Report and Written Opinion issued in co-pending application No. PCT/US2015/031378, dated Jul. 28, 2015.

* cited by examiner

*Primary Examiner* — Stephen Crow
(74) *Attorney, Agent, or Firm* — Dinsmore & Shohl LLP

(57) ABSTRACT

An elliptical exercise device has guide links pivotally attached to a frame and foot support links pivotally attached to the guide links. Horizontal control links couple the guide links to a crank system and vertical control links couple the foot support links to the crank system such that rotation of the crank system moves foot receiving areas in a generally elliptical path.

24 Claims, 5 Drawing Sheets

FIG. 2
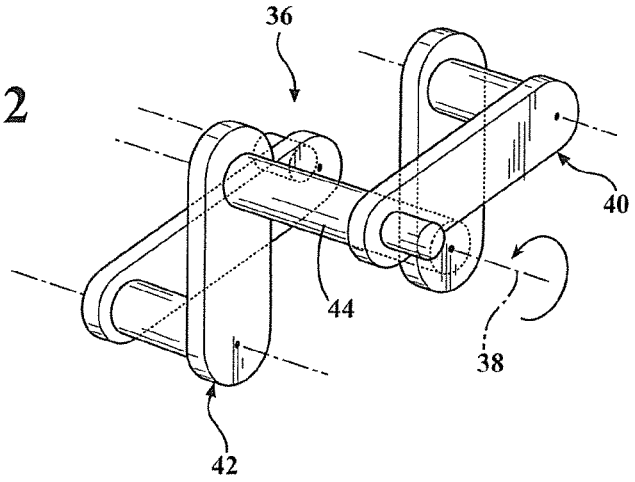
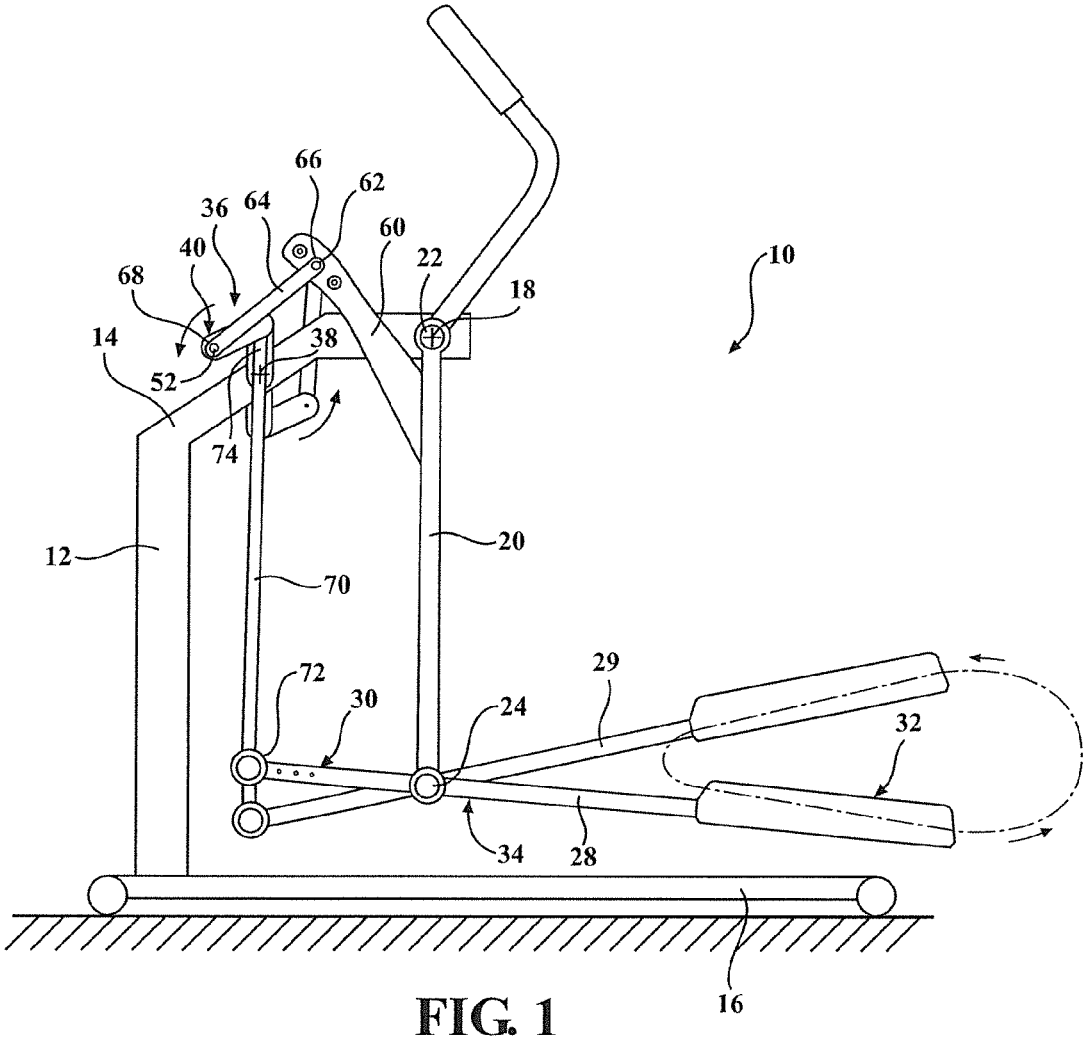
FIG. 1

ELLIPTICAL EXERCISE DEVICE

CROSS-REFERENCE TO RELATED APPLICATION

This application is a continuation-in-part of U.S. patent application Ser. No. 14/476,083, filed Sep. 3, 2014, which claims priority to U.S. provisional patent application 62/000,671 filed May 20, 2014. This application also claims priority to U.S. provisional patent application Ser. No. 62/000,671, filed May 20, 2014. The contents of all the aforementioned applications are incorporated herein by reference.

FIELD OF THE INVENTION

This invention relates generally to elliptical exercise devices in which the path of travel of a user's foot is generally elliptical.

BACKGROUND OF THE INVENTION

There are a number of exercise devices that operate to allow a user to implement a foot action following a generally closed, curved path of travel, simulating running and/or walking. These devices are generally referred to as "elliptical" exercise devices. Many such elliptical exercise devices are large, complicated, costly, and/or have undesirable characteristics related to the motion of the user's feet.

SUMMARY OF THE INVENTION

The present invention offers embodiments of an elliptical exercise device. Some embodiments offer reduced mechanical complexity and a path of motion with desirable characteristics.

A first embodiment of an elliptical exercise device includes a frame configured to be supported on a horizontal surface. The frame has a first pivot axis and a second pivot axis defined thereon. The second pivot axis is forward of the first pivot axis. A first and second guide link each have a first and a second attachment point defined thereon. Each guide link is pivotally attached, through its first attachment point, to the frame at the first pivot axis thereof. A first and a second foot support link each have a rear portion, a mid portion, and a forward portion. The rear portion of each support link defines a foot receiving area configured to support a user's foot thereon. The mid portion of each foot support link is pivotally connected to the second attachment point of a respective one of the guide links so that when the guide links reciprocate relative to the frame, they cause their respective foot support link to move in a path of travel having a horizontal component of motion. A crank system is pivotally attached to the frame at the second pivot axis thereof. The crank system is rotatable about the second pivot axis. A first and a second horizontal control link each have a first end coupled to a respective one of the guide links and a second end coupled to the crank system such that rotation of the crank system about the second pivot axis causes the respective first and second guide links to pivot about the first pivot axis such that the foot support links move in the path of travel having a horizontal component of motion. A first and a second vertical control link each have a first end coupled to the forward portion of a respective one of the foot support links and a second end coupled to the crank system such that rotation of the crank system about the second pivot axis pivots the foot support links with respect to the guide links and the foot receiving areas move in a path of travel having a vertical component of motion. The foot receiving area of each foot support link moves in a generally elliptical path when the crank system rotates about the second pivot axis.

In certain embodiments, each of the vertical control links is generally parallel with a respective one of guide links. In some embodiments, each of the guide links has a working length defined as a distance from the first attachment point to the second attachment point and each vertical control link has a length that is in the range of 0.8 to 1.2 times the working length of the guide links.

In certain embodiments, the foot support links are supported for movement only by the respective guide link and vertical control link. In some embodiments, each vertical control link and its respective guide link extend generally vertically when the respective foot support link is midway through the horizontal component of its path of travel.

In some versions, the vertical control links are rigid links and the first end of each vertical control link is coupled to the respective one of the foot support links by being pivotally connected directly to the respective one of the foot support links. The second end of each vertical control link is coupled to the crank system by being pivotally connected directly to a crank arm of the crank system.

In some versions, the horizontal control links are rigid links and a first end of each horizontal control link is coupled to the respective one of the guide links by being pivotally connected directly to the respective one of the guide links. The second end of each horizontal control link is coupled to the crank system by being pivotally connected directly to a crank arm of the crank system.

In certain embodiments, the crank system has a first and a second crank arm. The second end of the first horizontal control link and the second end of the first vertical control link are each pivotally connected to the first crank arm. The second end of the second horizontal control link and the second end of the second vertical control link are each pivotally connected to the second crank arm. In some versions, the pivotal connection between each horizontal control link and the respective crank arm is rotationally offset from the pivotal connection between the respective vertical control link and the respective crank arm. The horizontal control links may be outboard of the vertical control links.

In some versions, the pivotal connection between each horizontal control link and the respective crank arm and the pivotal connection between the respective vertical control link and the respective crank arm are at a shared axis. The horizontal control links may each extend rearwardly from the crank system to the respective guide link and be disposed generally horizontally when the respective guide link is at its forwardmost and rearwardmost positions.

In some versions, the first pivot axis is higher than the second pivot axis.

In certain embodiments, each guide link has a connection portion extending forwardly from a remainder of the guide link and the horizontal control links are coupled to the connection portion of the respective guide link. The coupling between each horizontal control link and the respective connection portion may be adjustable so as to adjust a length of the horizontal component of motion of the respective foot support link.

In certain embodiments, the coupling between the vertical control link and the respective foot support link is adjustable so as to adjust a height of the vertical component of motion of the respective foot receiving area.

In some versions, the horizontal control links each extend rearwardly from the crank system to the respective guide link and are disposed generally horizontally when the respective guide link is at its forwardmost and rearwardmost positions. Each horizontal control link may be pivotally connected to the respective guide link at a link attachment area at a third attachment point below the first attachment point. The third attachment points may be adjustable so as to adjust a length of the horizontal component of motion of the respective foot support link.

In some embodiments, a length of the horizontal component of motion of the foot support links and the height of the vertical component of motion of the foot receiving areas are adjustable. The adjustment may be a power adjustment and the horizontal and vertical components may be adjustable in a coordinated manner.

In some embodiments, the foot support links are generally horizontal when the respective foot receiving area is midway through its vertical path of travel. In an alternative embodiment, the exercise device further includes a first and a second resilient member, with each resilient member extending between a respective one of the foot support links and the frame.

Each guide link may further include a hand grip portion extending upwardly from the first attachment point.

BRIEF DESCRIPTION OF THE DRAWINGS

FIG. 1 is a side elevational view of an embodiment of an elliptical exercise device in accordance with the present invention;

FIG. 2 is a perspective view of a crank system which may be used with certain embodiments of the present invention;

DETAILED DESCRIPTION OF THE PREFERRED EMBODIMENTS

Figure 4:
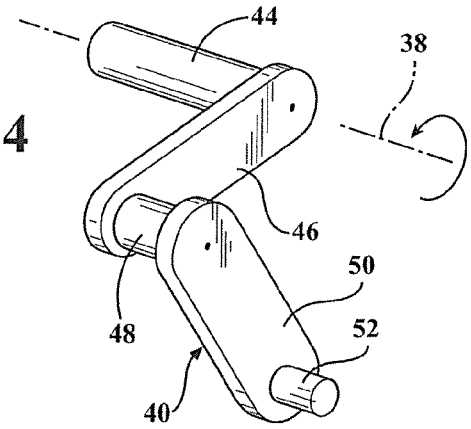
FIG. 4 is a perspective view of a portion of the crank system of FIG. 2, showing a single crank arm.

The present invention will be explained with reference to some particular embodiments, and it is to be understood that yet other embodiments, modifications, and variations thereof will be apparent to those of skill in the art in view of the teaching presented herein. As will be clear to those of skill in the art, an elliptical exercise device is designed to be used by a user placing each of their feet on a respective foot receiving area and then moving their feet along a closed elliptical path. As such, an elliptical exercise device includes left and right elements for supporting the respective left and right feet of the user. The right and left components of the exercise device are typically substantially the same, though the machine may be constructed such that the two foot receiving areas are 180 degrees out of phase. That is, when one foot receiving area is moving forwardly, the other foot receiving area is moving rearwardly. The present invention will be described primarily with reference to only one set of the components, with it being understood that the corresponding components of the other half of the device are constructed similarly. It should also be understood that the term "elliptical" is not limited to its precise mathematical definition, but is instead used in a more general sense to refer to a closed path of travel with curved portions. Some such elliptical paths of motion will have a longer horizontal component than vertical component.

FIG. 1 provides a side elevational view of a first embodiment of an elliptical exercise device 10 structured in accord with the principles of the present invention. The device includes a frame which is configured and operative to retain and support the various other components of the device on a horizontal surface such as a floor. The frame may be said to have an upper portion 14 and a lower portion 16, with the lower portion configured to contact the horizontal surface while the upper portion supports various components of the device 10. The frame 12 is typically fabricated from metal and/or composite materials, but any material may be used. A first pivot axis 18 is defined in the upper portion 14 of the frame 12. The frame 12 may be said to have a forward portion that is forward of the first pivot axis 18, which is to the left in the view of FIG. 1. The upper portion 14 of the frame of this embodiment substantially lacks any rearward portion rearward of the first pivot axis 18.

Figure 3:
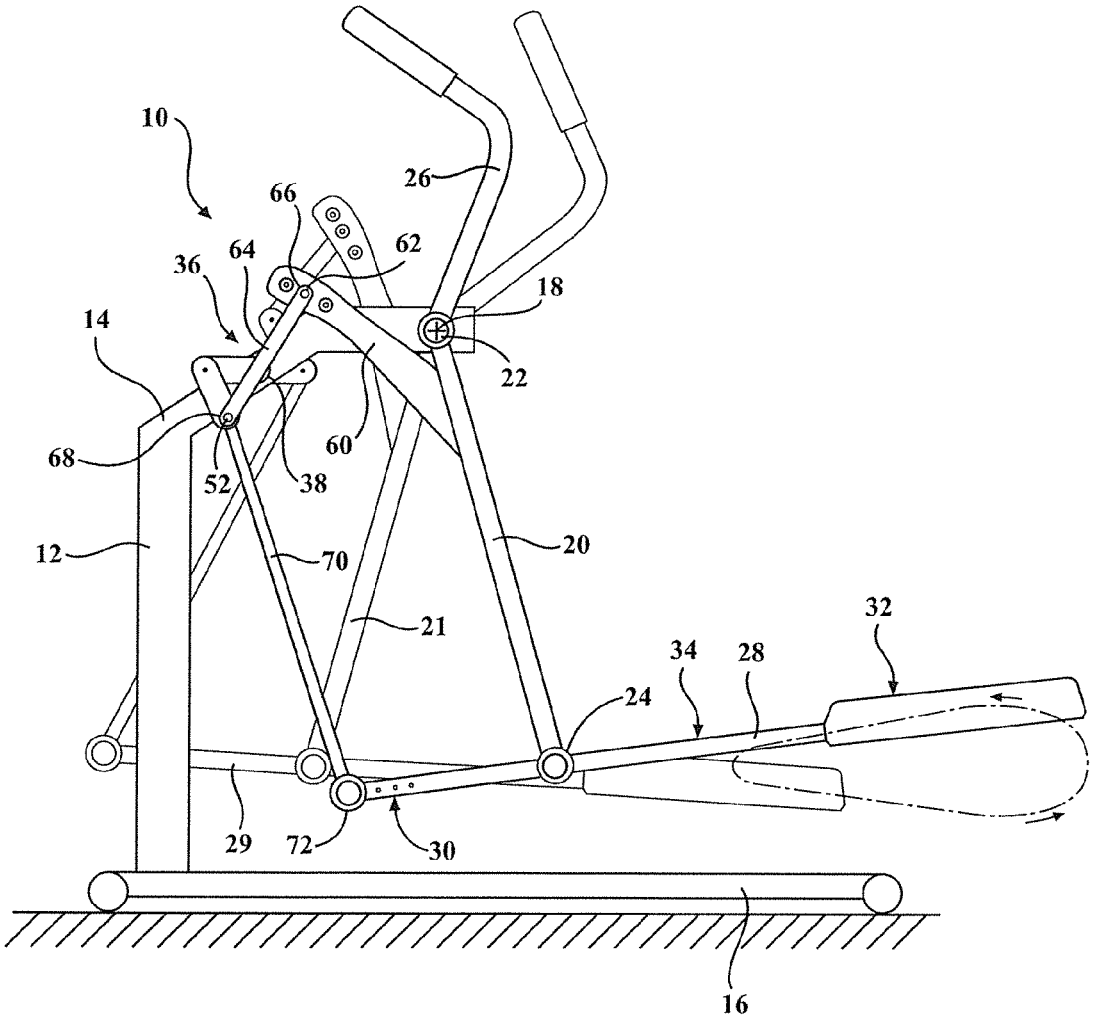
FIG. 3 is a side elevational view of the first embodiment of the elliptical exercise device with the movable elements in a different position than FIG. 1.

A pair of guide links are pivotally interconnected with the frame so as to be pivotable about the first pivot axis 18. A first guide link 20 is shown at the midpoint of its travel, wherein it is generally vertical. At this position, the second guide link is also generally vertical and disposed directly behind the first guide link 20, and is therefore not visible in FIG. 1. FIG. 3 is a similar side view but with the guide links in a different position. Specifically, left guide link 20 is rotated to what may be considered a rearward position while right guide link 21 is rotated to a forward position such that both guide links are visible. All left and right components may alternatively be referred to as first and second components for ease of description.

The guide link 20 may be said to have a first attachment point 22 towards its upper end and a second attachment point 24 at its lower end. The guide link 20 is pivotally interconnected with the first pivot axis 18 of the frame 12 at its first attachment point 22. In the illustrated embodiment, the guide link 20 further includes a hand grip portion 26 extending upwardly from the first attachment point 22.

The exercise device 10 further includes a first foot support link 28 and a second foot support link 29. Each foot support link 28 and 29 is pivotally interconnected with the respective first and second guide link 20 and 21. The foot support link 28 may be said to have a forward portion 30 at its forward end, a rear portion 32 at its rearward end, and a mid portion 34 extending between the forward portion and rear portion. As shown, the mid portion 34 of the foot support link 28 is pivotally interconnected with the lower end of the guide link 20, at the second attachment point 24 of the guide link 20. The rear portion 32 of the foot support link 28 defines a foot receiving area that is configured to support a user's foot thereon. It should be noted that references to forward and rear are made with respect to a direction a user is facing when using the device 10. A user places their feet on the foot receiving areas of the foot support links and faces towards the hand grip portions 26. As such, "forward" is to the left in FIGS. 1 and 3 and "rear" is to the right in FIGS. 1 and 3.

A crank system 36 is pivotally interconnected with the frame 12 such that the crank system 36 rotates about the second pivot axis 38 defined on the frame. In the illustrated embodiment, the second pivot axis 38 is forward of the first pivot axis 18 on the upper portion 14 of the frame 12. This means that the second pivot axis 38 is also on the forward portion of the frame. In the illustrated embodiment, the second pivot axis is a short distance lower than the first pivot axis 18. FIG. 2 provides a perspective view of an embodiment of a crank system 36 for use with some embodiments of the present invention. The crank system 36 has a first crank arm 40 and a second crank arm 42 both connected to a central element 44. The central element 44 extends along the second pivot axis 38 and rotates thereabout.

FIG. 4 provides a perspective view of a portion of the crank system including the central portion 44 and the first crank arm 40. The first crank arm 40 is shown at a different rotational position than in FIG. 2. As best shown in FIG. 4, the crank arm 40 has an inner portion 46 extending radially outwardly from the central portion 44. An inner journal 48 extends generally perpendicularly from an outer end of the inner portion 46 and defines an attachment point for a vertical control link, as will be described in more detail hereinbelow. An outer portion 50 of the crank arm 40 is connected to the other end of the inner journal 48 and extends in a plane generally parallel to the inner portion 46 but at an angle to the inner portion 46. An outer journal 52 extends perpendicularly from an outer end of the outer portion 50. The outer journal 52 provides an attachment point for a horizontal control link, as will be described hereinbelow. The journals 48 and 52 provide attachment points on the crank arm 40. In this embodiment, the attachment points 48 and 52 are rotationally offset with respect to one another. As will be clear to those of skill in the art, this rotational offset is chosen so as to provide a desirable path of motion.

Figure 5:
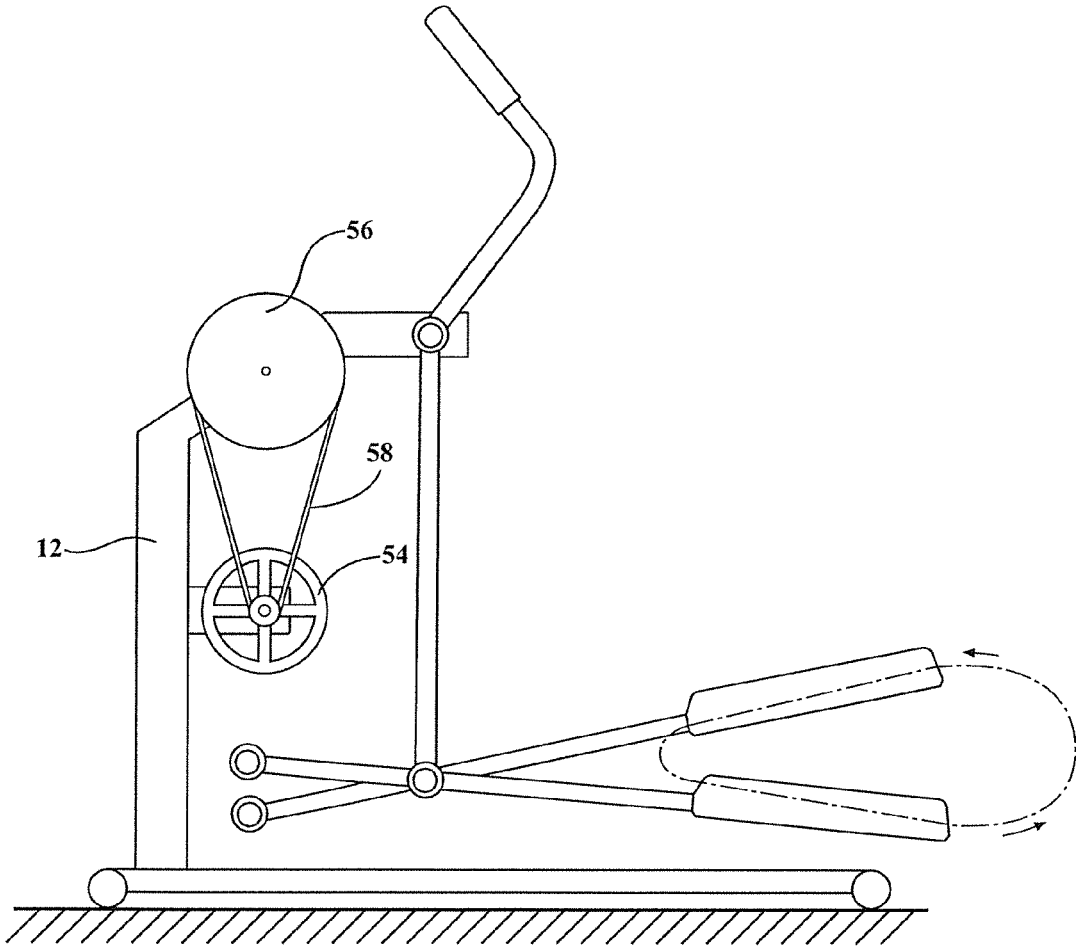
FIG. 5 is a side elevational view of a portion of an elliptical exercise device in accordance with the present invention, showing a flywheel system.

As will be described, the guide links and foot support links are coupled to the crank system such that rotation of the crank system causes the foot receiving areas 32 to move in a closed generally elliptical path. FIG. 5 shows a portion of the exercise device and illustrates a flywheel 54 which is pivotally supported on the frame 12. A pulley 56 forms part of or is interconnected with the crank system 36 and is connected to the flywheel 54 by a belt 58. The flywheel 54 and/or pulley 56 may include a load element such as an electrical or frictional resistance device. Alternatively, a flywheel and/or load element may be integrated with the crank system 36 or connected to the remainder of the device in other ways.

Referring again to FIGS. 1 and 3, the guide links each include a connection portion 60 extending forwardly from the main body of the guide link 20 just below the first attachment point 22. A third attachment point 62 is defined on this connection portion 60. A horizontal control link 64 has a first end pivotally connected directly to the third attachment point 62 of the connection portion 60 of the guide link 20. The horizontal control link 64 has a second end 68 that is pivotally connected directly to the outer journal 52 of the crank arm 40. The horizontal control link 64 may be a rigid link. As will be clear based on a review of FIGS. 1 and 3, rotation of the crank system 36 about the second pivot axis 38 causes the horizontal control link 64 to push and pull the guide link 20 such that it reciprocates about the first pivot axis 18. This causes the foot support link 28 to move in a path of travel having a horizontal component of motion. As shown, multiple attachment points may be provided on the connection portion 60 so as to change the location of the pivotal connection of the first end 66 of the horizontal control link 64 to the connection portion 60. By changing the connection point, the length of the horizontal component of motion of the foot support link is altered.

A first vertical control link 70 has a first end 72 pivotally connected to the forward portion 30 of the foot support link 28. The vertical control link 70 has a second end 74 that is pivotally coupled to the crank system 36. This connection is not easily seen in the figures due to the shape of the crank arm 40. The second end 74 is pivotally connected to the inner journal 48 of the crank arm 40. As shown in FIG. 1, the vertical control link 70 extends generally vertically and generally parallel to the main body of the guide link 20 when the respective foot support link 28 is midway through its horizontal path of travel. As shown in FIG. 3, the vertical control link 70 is angled with respect to vertical when the respective foot support link 28 is near its rearward position. However, the vertical control link 70 remains generally parallel to the main body of the guide link 20. As also shown, the vertical control link 70 has a length that is similar to the length of the guide link 20. Specifically, the guide link 20 may be said to have a working length defined between the first attachment point 22 and second attachment point 24. In some embodiments, the length of the vertical control link 70 is similar to the working length of the guide link 20. In some embodiments, the length of the link 70 is in the range of 0.8 to 1.2 times the working length of the guide link 20. This arrangement provides a generally parallelogram linkage and a desirable motion profile.

As the crank system 36 rotates about the second pivot axis 38, the vertical control link 70 is moved upwardly and downwardly thereby causing the respective foot support link 28 to pivot about the second attachment point 24 on the guide link 20, thereby causing the foot receiving area 32 of the foot support link 28 to move in a path of travel having a vertical component of motion. As shown, the forward portion 30 of the foot support link 28 may have multiple attachment points for connection to the vertical control link 70. By changing the attachment point, the height of the vertical path of travel of the foot receiving area 32 may be altered. The vertical control link 70 may be a rigid link with its ends being directly pivotally connected to the foot support link 28 and crank arm 40, respectively. As will be clear to those of skill in the art, the arrangement of the horizontal control links and the vertical control links causes the foot receiving areas of the foot support links to move in a generally elliptical path of travel as the crank system 36 rotates about the second pivot axis 38.

Figure 6:
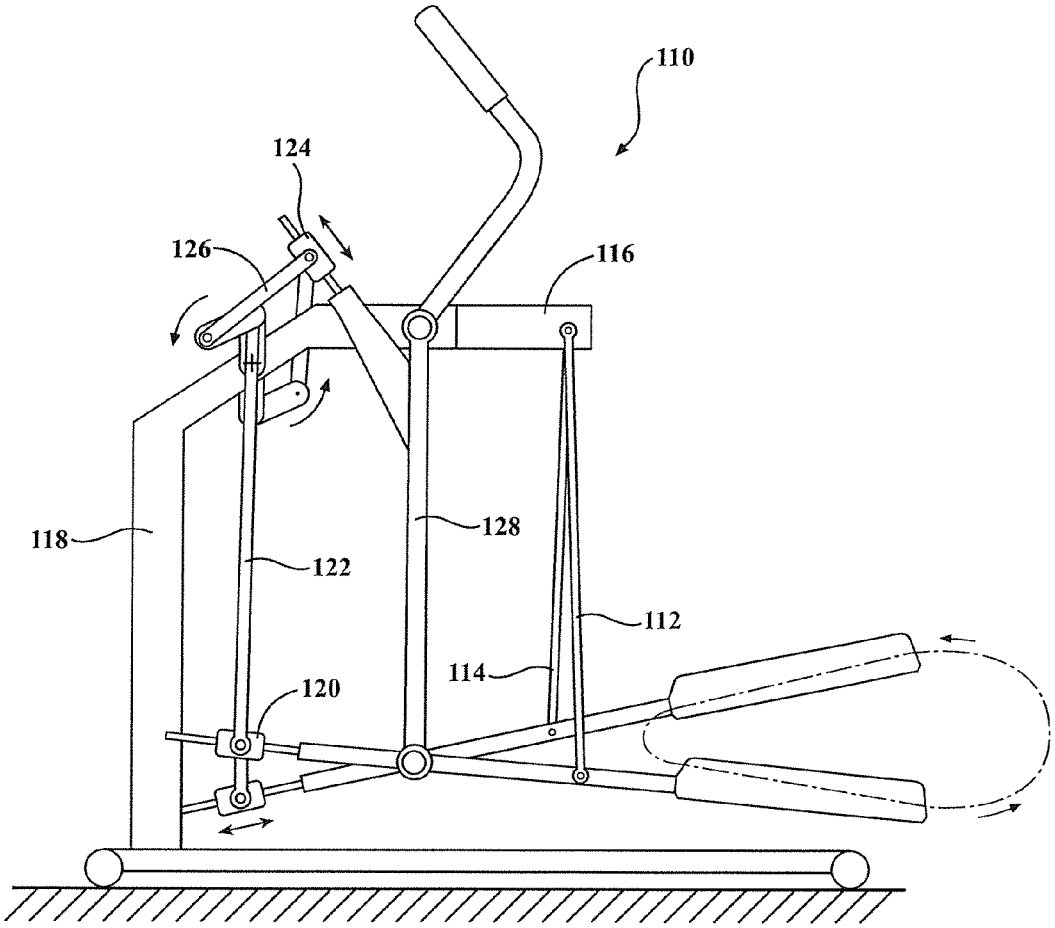
FIG. 6 is a side elevational view of an alternative embodiment of an elliptical exercise device in accordance with the present invention.

Referring now to FIG. 6, an alternative embodiment of an exercise device is shown at 110. This embodiment is similar to the prior embodiments but further includes a first resilient member 112 and a second resilient member 114. Each resilient member has a lower end connected to a respective foot support link and an upper end connected to a rear section 116 of a frame 118 of the device 110. Such resilient members may be provided to partially counteract the weight of the user on the foot receiving areas of the foot support links. The resilient members may take the form of an elongated piece of resilient material, such as an elastic material, or may take the form of a cable or cable system with a resilient member such as a spring. Further or different resilient members may also be used. Such resilient members may be used with other embodiments of the present invention.

Figure 7:
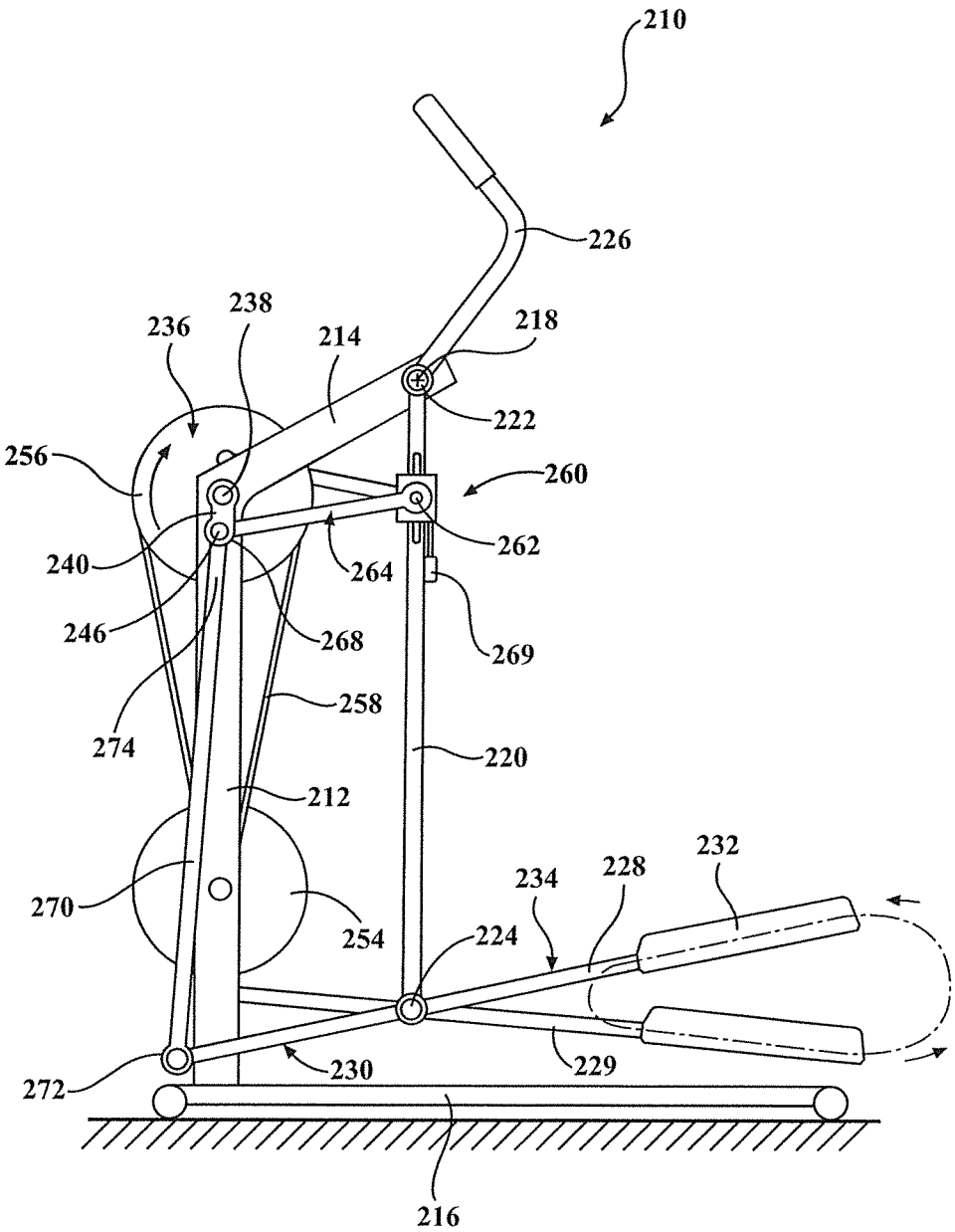
FIG. 7 is a side elevational view of another alternative embodiment of an elliptical exercise device in accordance with the present invention.

Referring now to FIG. 7, another alternative embodiment of an exercise device in accordance with the present invention is shown at 210. This embodiment operates similarly to the prior embodiments but has a different crank and linkage configuration. The device 210 includes a frame 212 with an upper portion 214 and a lower portion 216, with the lower portion configured to contact a horizontal support surface while the upper portion supports various components of the device 210. A first pivot axis 218 is defined in the upper portion 214 of the frame 212. The frame 212 may be said to have a forward portion that is forward of the first pivot axis 218, which is to the left in the view of FIG. 6. The upper portion 214 of the frame of this embodiment substantially lacks any rearward portion rearward of the first pivot axis 218, though may alternatively have a rearward portion such as to support resilient members as in FIG. 6.

A pair of guide links are pivotally interconnected with the frame so as to be pivotable about the first pivot axis 218. A first guide link 220 is shown at the midpoint of its travel, wherein it is generally vertical. At this position, the second guide link is also generally vertical and disposed directly behind the first guide link 220, and is therefore not visible in FIG. 6. As will be clear to those of skill in the art, the guide links pivot about the axis 218 such that the lower ends of the guide links move forwardly and rearwardly, as was described for the first embodiment.

The guide link 220 may be said to have a first attachment point 222 towards its upper end and a second attachment point 224 at its lower end. The guide link 220 is pivotally interconnected with the first pivot axis 218 of the frame 212 at its first attachment point 222. In the illustrated embodiment, the guide link 220 further includes a hand grip portion 26 extending upwardly from the first attachment point 222.

The exercise device 210 further includes a first foot support link 228 and a second foot support link 229. Each foot support link 228 and 229 is pivotally interconnected with the respective first and second guide link. The foot support link 228 may be said to have a forward portion 230 at its forward end, a rear portion 232 at its rearward end, and a mid portion 234 extending between the forward portion and rear portion. As shown, the mid portion 234 of the foot support link 228 is pivotally interconnected with the lower end of the guide link 220, at the second attachment point 224 of the guide link 220. The rear portion 232 of the foot support link 228 defines a foot receiving area that is configured to support a user's foot thereon.

A crank system 236 is pivotally interconnected with the frame 212 such that the crank system 236 rotates about a second pivot axis 238 defined on the frame. In the illustrated embodiment, the second pivot axis 238 is forward of the first pivot axis 218 on the upper portion 214 of the frame 212. This means that the second pivot axis 238 is also on the forward portion of the frame. In the illustrated embodiment, the second pivot axis is a short distance lower than the first pivot axis 218. The crank system 236 has a first crank arm 240 and a second crank arm (not shown, but diametrically opposed to first crank arm 240), both connected to a central shaft that extends along the second pivot axis 238 and rotates thereabout.

Unlike the prior embodiments, the crank arms of the crank system 236 may each have only a single attachment area for attaching links. This attachment area is labeled 246 for arm 240. As will be described in more detail below, both a vertical control link and a horizontal control link are pivoted to this attachment area 246 of the crank arm 240, such that they are both pivoted to the shared axis, which may be a journal. This simplifies the construction of the device 210.

The guide links and foot support links are coupled to the crank system 236 such that rotation of the crank system causes the foot receiving areas 232 to move in a closed generally elliptical path. A flywheel 254 may be pivotally supported on the frame 212 and a pulley 256 forms part of the crank system 236, with the flywheel and pulled connected by a belt 258. The flywheel 254 and/or pulley 256 may include a load element such as an electrical or frictional resistance device. Alternatively, a flywheel and/or load element may be integrated with the crank system 236 or connected to the remainder of the device in other ways.

The guide link 220 has a link attachment area 260 defined a short distance below the first attachment point 222. A third attachment point 262 is defined in this link attachment area 260. A horizontal control link 264 has a first end pivotally connected directly to the third attachment point 262 of the guide link 220. The horizontal control link 64 has a second end 268 that is pivotally connected directly to the crank arm 240 at the attachment area 246. The horizontal control link 264 may be a rigid link. As will be clear based on a review of FIG. 6, rotation of the crank system 236 about the second pivot axis 238 causes the horizontal control link 264 to push and pull the guide link 220 such that it reciprocates about the first pivot axis 218. This causes the foot support link 228 to move in a path of travel having a horizontal component of motion. In some embodiments, the attachment position of the third attachment point 262 may be adjusted upwardly and downwardly within the link attachment area 260. By changing the location, the length of the horizontal component of motion of the foot support link is altered. In the illustrated embodiment, an adjustment mechanism 269 is provided for adjusting the third attachment point upwardly and downwardly. The adjustment mechanism may be a manual or powered mechanism, such as a worm drive that moves a sliding block. Preferably the positions of the third attachment point on both guide links are adjusted by the same amount. Other adjustment approaches may also be used.

As shown, each horizontal control link 264 extends rearwardly from the crank system 236 to the respective guide link. The horizontal control links may be said to extend generally horizontally. As will be clear to those of skill in the art, when the guide links are at their forward or rearward positions, the horizontal control links will both be close to horizontal and at the midpoint of travel, the position in FIG. 7, they move to a less horizontal position.

A first vertical control link 270 has a first end 272 pivotally connected to the forward portion 230 of the first foot support link 228. The vertical control link 270 has a second end 274 that is pivotally coupled to the crank system 236 at the attachment area 246. As shown in FIG. 7, the vertical control link 270 extends generally vertically and generally parallel to the main body of the guide link 220 when the respective foot support link 228 is midway through its horizontal path of travel. As will be clear to those of skill in the art, the vertical control link 270 will angled with respect to vertical when the respective foot support link 228 is near its rearward position. However, the vertical control link 270 remains generally parallel to the main body of the guide link 220. As also shown, the vertical control link 270 has a length that is similar to the length of the guide link 220. Specifically, the guide link 220 may be said to have a working length defined between the first attachment point 222 and second attachment point 224. In some embodiments, the length of the vertical control link 270 is similar to the working length of the guide link 220. In some embodiments, the length of the link 270 is in the range of 0.8 to 1.2 times the working length of the guide link 220. This arrangement provides a generally parallelogram linkage and a desirable motion profile.

As the crank system 236 rotates about the second pivot axis 238, the vertical control link 270 is moved upwardly and downwardly thereby causing the respective foot support link 228 to pivot about the second attachment point 224 on the guide link 220, thereby causing the foot receiving area 232 of the foot support link 228 to move in a path of travel having a vertical component of motion. The forward portion 230 of the foot support link 228 may have multiple attachment points for connection to the vertical control link 270, and may have an adjustment mechanism similar to the mechanism 269. By changing the attachment point position, the height of the vertical path of travel of the foot receiving area 232 may be altered. The vertical control link 270 may be a rigid link with its ends being directly pivotally connected to the foot support link 228 and crank arm 240, respectively. As will be clear to those of skill in the art, the arrangement of the horizontal control links and the vertical control links causes the foot receiving areas of the foot support links to move in a generally elliptical path of travel as the crank system 236 rotates about the second pivot axis 238.

As will be clear to those of skill in the art, the embodiments of FIGS. 1-7 have foot support links that are supported entirely from above. In the case of FIGS. 1-4 and 7, the foot support links are supported only by the guide links and the vertical control links. Put another way, all support is forward of the foot receiving areas and no support is provided rear of the guide link attachment. In FIG. 6, support is also provided by the resilient member, rearward of the guide link. Many existing elliptical exercise devices have a track or some type of support that supports the foot receiving area or member from below. The illustrated embodiments do not have such a track or support from below.

FIG. 6 also illustrates an optional approach to allowing adjustment of the horizontal and/or vertical range of motion of the device. An adjuster 120 is provided on the forward portion of the foot support link with the vertical control link 122 attached thereto. The adjuster 120 may be adjusted fore and aft so as to change the range of vertical motion. Another adjuster 124 is provided where the horizontal control link 126 attaches to the guide link 128. By adjusting the adjuster 124 in and out, the horizontal range of motion may be adjusted. The adjusters 120 and 124 may take a variety of forms, such as a screw or mechanical drive, or a hydraulic adjustment. Further options will be clear to those of skill in the art. The adjusters 120 and 124 may also represent manual adjustment elements which may be adjusted in a variety of ways. In some versions of the present invention, the adjusters operate in a coordinated fashion such that the vertical and horizontal components of motion are adjusted in a coordinated manner. Other approaches to adjusting horizontal and/or vertical range may also be used, such as adjusting the position where links attach to the crank system.

While the horizontal and vertical control links are shown as being directly pivotally connected to the crank arms and to the respective guide links and foot support links, alternative embodiments of the present invention may utilize indirect connections, such as bell cranks or other indirect couplings at one or both ends. However, the direct pivotal connections are preferred for some embodiments.

The foregoing describes some particular embodiments of the present invention. Other embodiments, modifications, and variations thereof will be apparent to those of skill in the art in view of the teaching presented herein. The foregoing is not meant to be a limitation upon the practice of the present invention. For example, any feature of any of the embodiments disclosed herein may be used with any other feature or embodiment disclosed herein. It is the following claims, including all equivalents, which define the scope of the invention.

The invention claimed is:

1. An elliptical exercise device comprising: a frame configured to be supported on a horizontal surface, the frame having a first pivot axis and a second pivot axis defined thereon, the second pivot axis being forward of the first pivot axis; a first and a second guide link each having a first and a second attachment point defined thereon, each guide link being pivotally attached, through its first attachment point, to the frame at the first pivot axis thereof;

a first and a second foot support link each having a rear portion, a mid portion and a forward portion, the rear portion of each support link defining a foot receiving area configured to support a user's foot thereupon, the mid portion of each foot support link being pivotally connected to the second attachment point of a respective one of the guide links so that when the guide links reciprocate relative to the frame, they each cause their respective foot support link to move in a path of travel having a horizontal component of motion;

a crank system pivotally attached to the frame at the second pivot axis thereof, the crank system being rotatable about the second pivot axis;

a first and a second horizontal control link each having a first end coupled to a respective one of the guide links and a second end coupled to the crank system at an offset crank axis such that rotation of the crank system about the second pivot axis causes the respective first and second guide links to pivot about the first pivot axis such that the foot support links move in the path of travel having a horizontal component of motion;

a first and a second vertical control link each having a first end coupled to the forward portion of a respective one of the foot support links and a second end coupled to the crank system at said offset crank axis such that rotation of the crank system about the second pivot axis pivots the foot support links with respect to the guide links and the foot receiving areas move in a path of travel having a vertical component of motion, whereby a foot receiving area of each foot support link moves in a generally elliptical path when the crank system rotates about the second pivot axis.

2. An elliptical exercise device in accordance with claim 1, wherein each of the vertical control links is generally parallel with the respective one of the guide links.

3. An elliptical exercise device in accordance with claim 2, wherein:

the guide links have a working length defined as a distance from the first attachment point to the second attachment point; and the vertical control links have a length that is in the range of 0.8 to 1.2 times the working length of the guide links.

4. An elliptical exercise device in accordance with claim 1, wherein the foot support links are supported for movement only by the respective guide link and vertical control link.

5. An elliptical exercise device in accordance with claim 1, wherein each vertical control link and its respective guide link extends generally vertically when the respective foot support link is midway through the horizontal component of its path of travel.

6. An elliptical exercise device in accordance with claim 1, wherein:

the vertical control links are rigid links;

the first end of each vertical control link is coupled to the respective one of the foot support links by being pivotally connected directly to the respective one of the foot support links; and the second end of each vertical control link is coupled to the crank system by being pivotally connected directly to a crank arm of the crank system.

7. An elliptical exercise device in accordance with claim 1, wherein:

the horizontal control links are rigid links;

the first end of each horizontal control link is coupled to the respective one of the guide links by being pivotally connected directly to the respective one of the guide links; and the second end of each horizontal control link is coupled to the crank system by being pivotally connected directly to a crank arm of the crank system.

8. An elliptical exercise device in accordance with claim 1, wherein:

the crank system has a first and a second crank arm;

the second end of the first horizontal control link and the second end of the first vertical control link each being pivotally connected with the first crank arm; and the second end of the second horizontal control link and the second end of the second vertical control link each being pivotally connected to the second crank arm.

9. An elliptical exercise device in accordance with claim 8, wherein the horizontal control links are outboard of the vertical control links.

10. An elliptical exercise device in accordance with claim 8, wherein the pivotal connection between each horizontal control link and the respective crank arm and the pivotal connection between the respective vertical control link and the respective crank arm are at a shared axis.

11. An elliptical exercise device in accordance with claim 10, wherein the horizontal control links each extend rearwardly from the crank system to the respective guide link and are disposed generally horizontally when the respective guide link is at its forwardmost and rearwardmost positions.

12. An elliptical exercise device in accordance with claim 1, wherein the first pivot axis is higher than the second pivot axis.

13. An elliptical exercise device in accordance with claim 1, wherein each guide link has a connection portion extending forwardly from a remainder of the guide link, the horizontal control links each being coupled to the connection portion of the respective guide link.

14. An elliptical exercise device in accordance with claim 13, wherein the coupling between each horizontal control link and the respective connection portion is adjustable so as to adjust a length of the horizontal component of motion of the respective foot support link.

15. An elliptical exercise device in accordance with claim 1, wherein the coupling between each vertical control link and the respective foot support link is adjustable so as to adjust a height of the vertical component of motion of the respective foot receiving area.

16. An elliptical exercise device in accordance with claim 1, wherein the horizontal control links each extend rearwardly from the crank system to the respective guide link and are disposed generally horizontally when the respective guide link is at its forwardmost and rearwardmost positions.

17. An elliptical exercise device in accordance with claim 16, wherein each horizontal control link is pivotally connected to the respective guide link at a link attachment area at a third attachment point below the first attachment point.

18. An elliptical exercise device in accordance with claim 17, wherein each of the third attachment points is adjustable so as to adjust a length of the horizontal component of motion of the respective foot support link.

19. An elliptical exercise device in accordance with claim 1, wherein a length of the horizontal component of motion of the foot support links and a height of the vertical component of motion of the foot receiving areas are adjustable.

20. An elliptical exercise device in accordance with claim 19, wherein the adjustable horizontal and vertical components of motion are power adjustable, the horizontal and vertical components being adjustable in a coordinated manner.

21. An elliptical exercise device in accordance with claim 1, wherein the foot support links are generally horizontal when the respective foot receiving area is midway through its vertical path of travel.

22. An elliptical exercise device in accordance with claim 1, further comprising a first and a second resilient member, each resilient member extending between a respective one of the foot support links and the frame.

23. An elliptical exercise device in accordance with claim 1, wherein each guide link further includes a hand grip portion extending upwardly from the first attachment point.

24. An elliptical exercise device in accordance with claim 1, wherein the crank system has a first and a second crank arm, each of the crank arms having two attachment points defined thereon.

* * * * *